US011732623B2

(12) United States Patent
Heng et al.

(10) Patent No.: US 11,732,623 B2
(45) Date of Patent: Aug. 22, 2023

(54) MUFFLER, COMPRESSOR ASSEMBLY, AND REFRIGERATOR

(71) Applicant: GREE GREEN REFRIGERATION TECHNOLOGY CENTER CO., LTD. OF ZHUHAI, Zhuhai (CN)

(72) Inventors: Panpan Heng, Zhuhai (CN); Chuanshun Huang, Zhuhai (CN)

(73) Assignee: GREE GREEN REFRIGERATION TECHNOLOGY CENTER CO., LTD. OF ZHUHAI, Zhuhai (CN)

( * ) Notice: Subject to any disclaimer, the term of this patent is extended or adjusted under 35 U.S.C. 154(b) by 326 days.

(21) Appl. No.: 17/058,096

(22) PCT Filed: Dec. 12, 2018

(86) PCT No.: PCT/CN2018/120665

§ 371 (c)(1),
(2) Date: Nov. 23, 2020

(87) PCT Pub. No.: WO2020/037891

PCT Pub. Date: Feb. 27, 2020

(65) Prior Publication Data

US 2021/0215146 A1 Jul. 15, 2021

(30) Foreign Application Priority Data

Aug. 24, 2018 (CN) ..... 201810975606.5

(51) Int. Cl.

| | |
|---|---|
| ***F01N 1/02*** | (2006.01) |
| ***F01N 1/08*** | (2006.01) |
| ***F04B 39/00*** | (2006.01) |

(52) U.S. Cl.
CPC ..... *F01N 1/02* (2013.01); *F04B 39/0061* (2013.01); *F01N 2490/08* (2013.01); *F01N 2490/15* (2013.01)

(58) Field of Classification Search
CPC .. F04B 39/00; F04B 39/0061; F04B 39/0066; F04B 39/0055; F04B 39/0027;
(Continued)

(56) References Cited

U.S. PATENT DOCUMENTS 3,968,854 A * 7/1976 Gordon ..... F01N 3/05 181/269
4,061,444 A * 12/1977 Dirk ..... F04B 39/0055 181/269

(Continued)

FOREIGN PATENT DOCUMENTS

CN 1187588 A * 7/1998
CN 2903469 Y * 5/2007

(Continued)

*Primary Examiner* — Edgardo San Martin
(74) *Attorney, Agent, or Firm* — Kilpatrick Townsend & Stockton LLP

(57) ABSTRACT

A muffler includes a housing and a partition member. The housing includes a cavity, a gas inlet, and a gas outlet. The gas inlet and the gas outlet are respectively in communication with the cavity. The partition member is disposed in the housing. The partition member partitions the cavity into a resonant cavity and a muffling cavity that are isolated from each other. The resonant cavity is in communication only with the gas inlet. The muffling cavity is in communication with both the gas inlet and the gas outlet.

19 Claims, 4 Drawing Sheets

(58) Field of Classification Search
CPC . F01N 1/02; F01N 1/023; F01N 1/089; F01N 1/08; F01N 2490/08; F01N 2490/15; F01N 2490/155
See application file for complete search history.

(56) References Cited

U.S. PATENT DOCUMENTS 4,209,076 A * 6/1980 Franco ..... F01N 1/02 181/275
4,333,544 A * 6/1982 Seeger ..... F01N 1/02 181/266
5,734,134 A * 3/1998 Park ..... F02M 35/1255 181/403
5,804,777 A * 9/1998 Kim ..... F04B 39/0055 181/282
5,971,720 A * 10/1999 Fagotti ..... F04B 39/0055 181/403
6,012,908 A * 1/2000 Tanaka ..... F04B 39/1073 417/312
8,246,320 B2 * 8/2012 Park ..... F04B 39/0061 417/540
8,517,697 B2 * 8/2013 Kinjo ..... F04B 39/0061 181/249
9,709,048 B2 * 7/2017 Kinjo ..... F04B 35/04
10,539,126 B2 * 1/2020 Doi ..... F04B 39/0061
2022/0170448 A1 * 6/2022 Wu ..... F04B 39/0061

FOREIGN PATENT DOCUMENTS

CN 101196183 A * 6/2008 ..... F04B 39/0061
CN 201306287 Y * 9/2009
CN 203670148 U * 6/2014
CN 107100820 A * 8/2017 ..... F04B 39/0083
CN 207647727 U * 7/2018
CN 109139415 A * 1/2019 ..... F04B 39/0083
CN 212803502 U * 3/2021
CN 112901453 A * 6/2021
CN 114151168 A * 3/2022
DE 4041439 A1 * 6/1992
KR 940000694 Y1 * 2/1994
KR 100314058 B1 * 11/2001
KR 100296581 B1 * 5/2002
KR 20050025500 A * 3/2005
KR 20070077893 A * 7/2007
WO WO-2006011082 A1 * 2/2006 ..... F04B 39/0061

* cited by examiner

MUFFLER, COMPRESSOR ASSEMBLY, AND REFRIGERATOR

CROSS REFERENCE TO RELATED APPLICATIONS

This application claims all benefits accruing under 35 U.S.C. § 119 from China Patent Application No. 201810975606.5, filed on Aug. 24, 2018 in the China National Intellectual Property Administration, the entire content of which is hereby incorporated by reference. This application is a national phase under 35 U.S.C. § 120 of international patent application PCT/CN2018/120665, entitled "MUFFLER, COMPRESSOR ASSEMBLY, AND REFRIGERATOR" filed on Dec. 12, 2018, the content of which is also hereby incorporated by reference.

FIELD

The present disclosure relates to the field of refrigeration devices, and specifically, to a muffler, a compressor assembly, and a refrigerator.

BACKGROUND

At present, a compressor of a refrigerator is a small sized piston type refrigeration compressor with a structure of a crank-connecting rod mechanism. In the compressor, a connecting rod and a piston is driven by a motor-driven crankshaft, and a refrigerant is suck and compressed through suction and exhaust reed valves. As the suction and compression of the refrigerant at a specific frequency are not continuous, the refrigerant may jitter during the transfer process, and consequently, gas noise is generated. To reduce the noise, a suction muffler and an exhaust muffler are respectively disposed at a gas inlet pipe and a gas exhaust pipe of the compressor. An existing suction muffler generally includes an upper muffling chamber, a lower muffling chamber, and a baffle plate with a conducting pipe. Structures of the muffling chambers are relatively simple to facilitate manufacture and assembly, whereas muffling effects for low frequency noise and medium-high frequency noise are not ideal.

SUMMARY

The present disclosure provides a muffler, a compressor assembly, and a refrigerator.

According to an aspect of the present disclosure, a muffler including a housing and a partition member is provided. The housing includes a cavity, a gas inlet, and a gas outlet. The gas inlet and the gas outlet are respectively in communication with the cavity. The partition member is disposed in the housing. The partition member partitions the cavity into a resonant cavity and a muffling cavity that are isolated from each other. The resonant cavity is in communication only with the gas inlet. The muffling cavity is in communication with both the gas inlet and the gas outlet.

In some embodiments, the partition member includes a first partition plate. The first partition plate partitions the cavity into the resonant cavity and the muffling cavity. A gas inflow channel member in communication with the gas inlet and the muffling cavity is disposed in the housing. A first through hole in communication with the resonant cavity is defined on the gas inflow channel member.

In some embodiments, the partition member further includes a second partition plate. The second partition plate is disposed on the first partition plate at an angle to partition the resonant cavity into two resonant chambers. The second partition plate defines a second through hole to communicate the two resonant chambers with each other.

In some embodiments, the muffling cavity includes a plurality of muffling chambers. Gas entering the cavity from the gas inlet sequentially passes through each of the muffling chambers and flowing out from the gas outlet.

In some embodiments, the partition member includes a third partition plate and a fourth partition plate disposed at an angle with respect to each other, to partition the muffling cavity into a plurality of muffling chambers. The third partition plate is joined to the first partition plate. The plurality of muffling chambers include a first muffling cavity, a second muffling cavity, a third muffling cavity, and a fourth muffling cavity along a gas flowing direction. The first muffling cavity is in communication with the gas inflow channel member, and the fourth muffling cavity is in communication with the gas outlet.

In some embodiments, the muffler includes a fifth partition plate disposed in the third muffling cavity. The fifth partition plate partitions the third muffling cavity into two portions.

In some embodiments, the housing includes a housing body and a cover. The housing body defines an opening. The partition member is disposed in the housing body through the opening, the cover covers the opening of the housing body. The gas inlet is located on the housing body, and the gas outlet is located on the cover.

In some embodiments, the muffler includes a gas outflow pipe disposed on the cover in a penetrating manner. The gas outlet is located at an end, away from the housing body, of the gas outflow pipe.

In some embodiments, an inner surface of the housing body defines a first slot and a second slot. An inner surface of the cover defines a third slot and a fourth slot. The first partition plate engages with the first slot and the third slot in an insertion manner. The fourth partition plate engages with the second slot and the fourth slot in an insertion manner.

In some embodiments, a first end of the fifth partition plate is joined to the cover. A gap allowing gas to flow therethrough is defined between a second end of the fifth partition plate and the third partition plate.

In some embodiments, a bottom of the housing defines an oil leakage hole. The oil leakage hole is in communication with each of the muffling chambers.

In some embodiments, the first muffling cavity and the second muffling cavity are located below the third muffling cavity and the fourth muffling cavity. The oil leakage hole is correspondingly located below the fourth partition plate and is in communication with both the third muffling cavity and the fourth muffling cavity.

According to another aspect of the present disclosure, a compressor assembly including the above-described muffler is provided.

According to another aspect of the present disclosure, a refrigerator including the above-described compressor assembly is provided.

BRIEF DESCRIPTION OF THE DRAWINGS

Accompanying drawings that constitute a part of the present disclosure are used for providing a further understanding of the present disclosure. Exemplary embodiments of the present disclosure and descriptions of the embodiments are used for describing the present disclosure, and do not constitute any inappropriate limitation to the present disclosure.

DETAILED DESCRIPTION OF THE EMBODIMENTS

The embodiments of the present disclosure are clearly and completely described below with reference to the accompanying drawings. The described embodiments are only some embodiments of the present disclosure, rather than all of the embodiments of the present disclosure. The following description of at least one exemplary embodiment is merely illustrative, and not intended to provide any limitation on the present disclosure or its disclosure or use.

It should be noted that terms used herein are only for describing specific implementations and are not intended to limit exemplary implementations according to the present disclosure. Unless the context expressly indicates, the singular form used herein is intended to include the plural form. In addition, it should be further understood that terms "comprise" and/or "include" used in the present specification indicate that there are features, steps, operations, devices, components, and/or combinations thereof.

Unless otherwise specified, the relative arrangement of components and steps, the numerical expressions, and the numerical values described in the embodiments do not limit the scope of the present disclosure. In addition, it should be understood that, for ease of description, sizes of various parts shown in the accompanying drawings are not drawn according to actual scales. In all examples shown and described herein, any specific value should be interpreted as merely exemplary, rather than as a limitation. Therefore, other examples of the exemplary embodiments may have different values. It should be noted that similar reference numbers and letters designate similar items in the following accompanying drawings. Therefore, once an item is defined in description of an accompanying drawing, the item does not need to be further described in description of the subsequent accompanying drawings.

Figure 1:
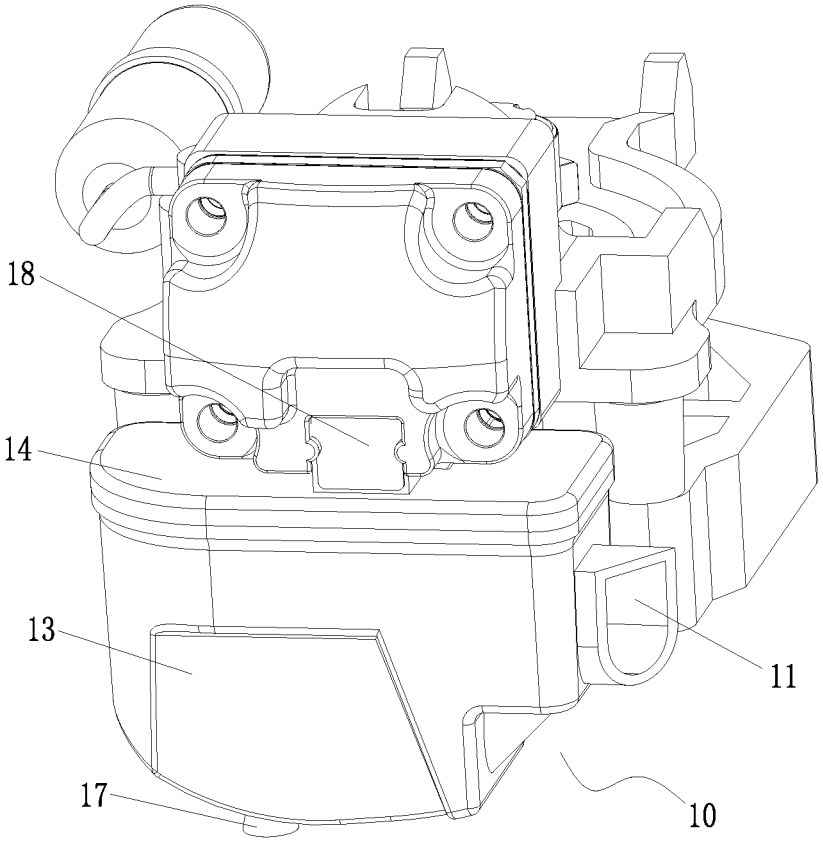
FIG. 1 is a schematic structural view of a muffler according to an embodiment of the present disclosure.
Figure 2:
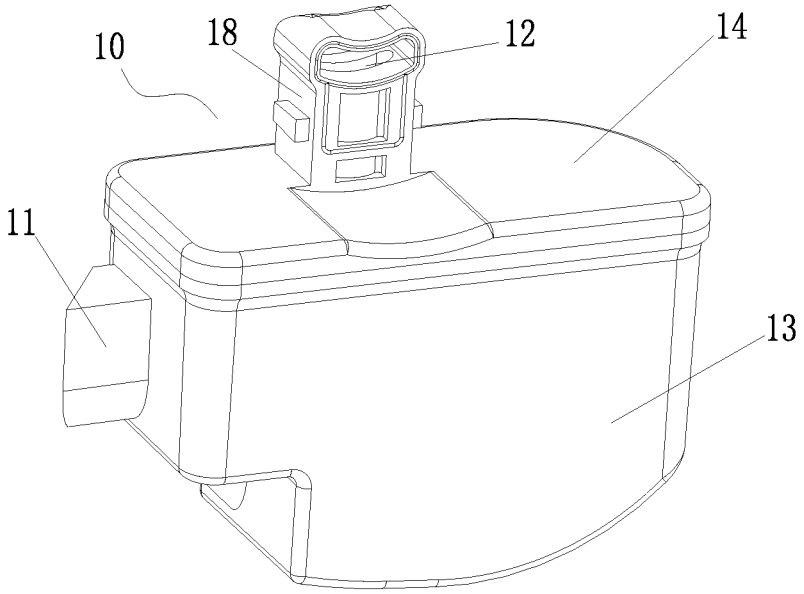
FIG. 2 is a schematic structural view of the muffler of FIG. 1 from another perspective.
Figure 3:
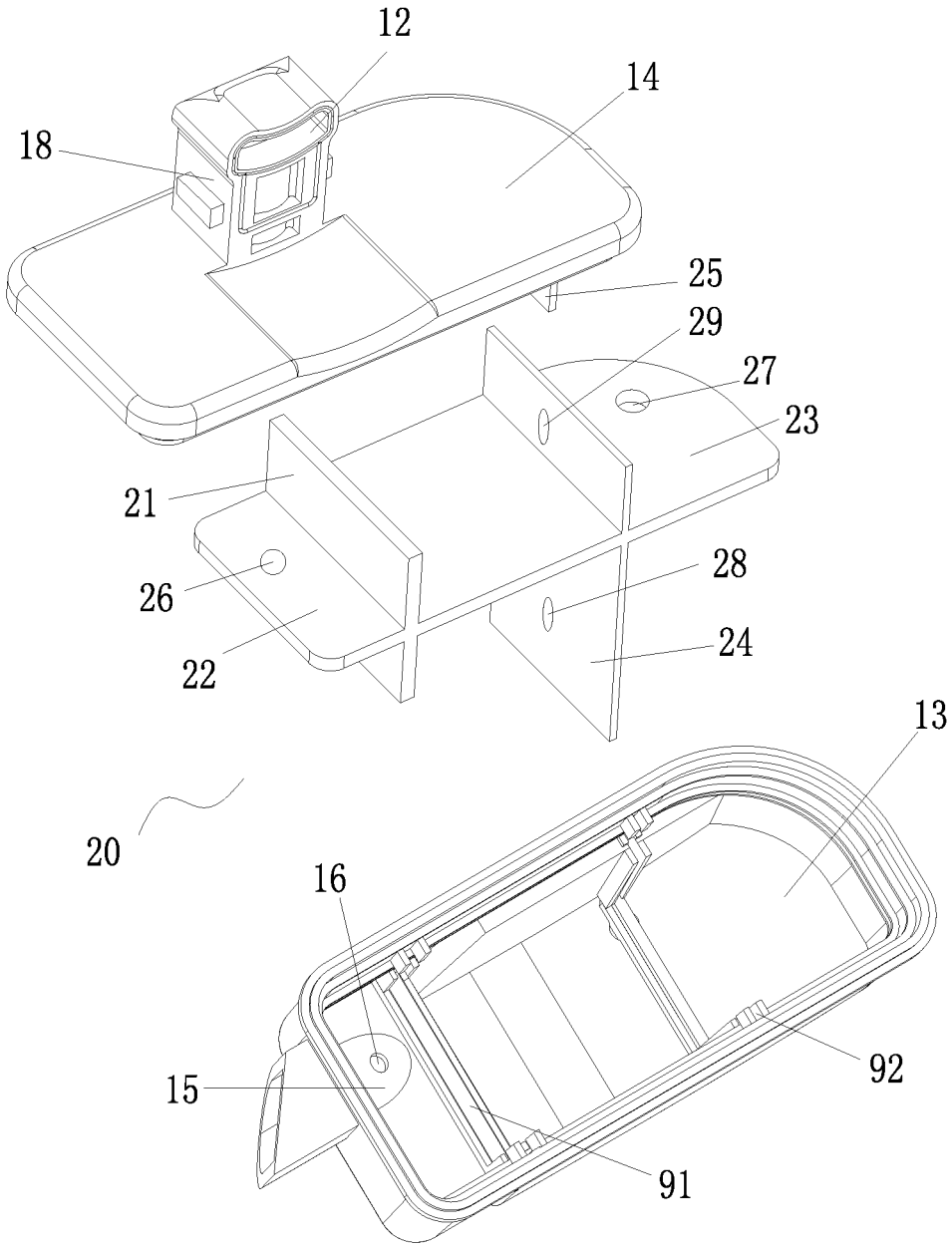
FIG. 3 is a schematic structural, explosive view of the muffler of FIG. 2.
Figure 4:
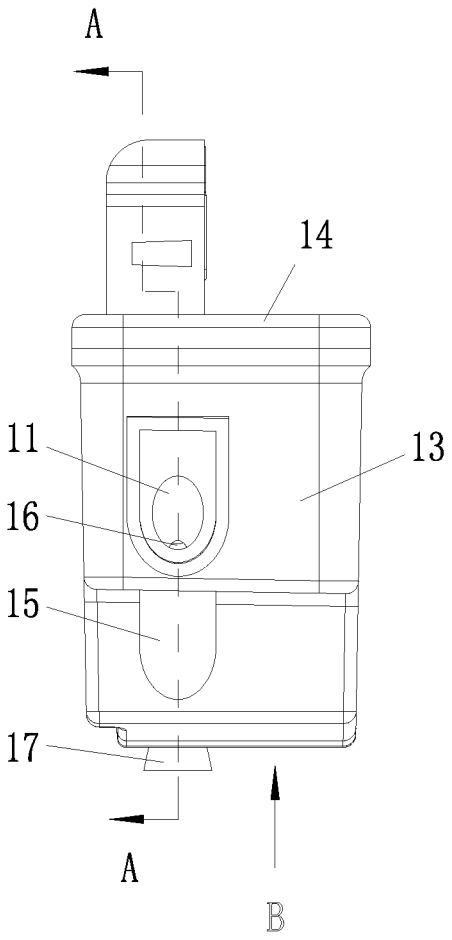
FIG. 4 is a schematic structural view of the muffler of FIG. 2 taken from a left perspective.

As shown in FIG. 1 to FIG. 3, an embodiment of a muffler includes a housing 10 and a partition member 20. The housing 10 defines a cavity, a gas inlet 11, and a gas outlet 12. The gas inlet 11 and the gas outlet 12 are respectively communicated with the cavity. The partition member 20 is disposed in the housing 10. The partition member 20 partitions the cavity into a resonant cavity and a muffling cavity that are isolated from each other. The resonant cavity is in communication only with the gas inlet 11. The muffling cavity is in communication with both the gas inlet 11 and the gas outlet 12. In some embodiments, a cross-sectional area of the gas outlet 12 is in a range from 27 $mm^2$ to 34 $mm^2$.

By applying the present embodiment, the muffling cavity and the resonant cavity are formed in the cavity of the muffler, and the gas entering from the gas inlet 11 is passes through the muffling cavity and being discharged from the gas outlet 12. When the gas passes through the muffling cavity, wave peaks and wave valleys of medium frequency and high frequency noises become gentle, which effectively reduces the volume of this part of noises. The resonant cavity is in communication only with the gas inlet 11, so that low frequency noise can be repeatedly reflected and eliminated in the resonant cavity. The present embodiment can simultaneously eliminate the noises in multiple frequency bands in low frequency and medium-high frequency, which effectively improves the effect of noise reduction.

As shown in FIG. 1 to FIG. 3, in the present embodiment, the housing 10 includes a housing body 13 and a cover 14. The housing body 13 defines an opening. The partition member 20 is disposed in the housing body 13 through the opening. The cover 14 covers the opening of the housing body 13. The gas inlet 11 is located on the housing body 13, and the gas outlet 12 is located on the cover 14. This structure is simple, and is easy to produce and assemble.

Figure 5:
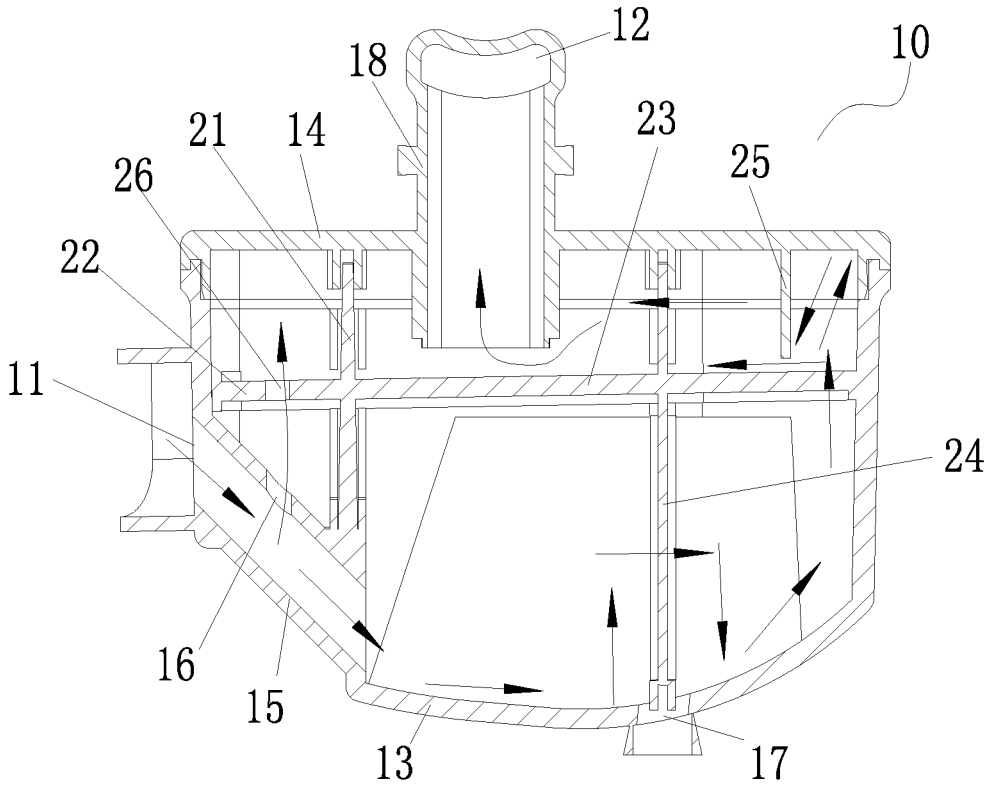
FIG. 5 is a schematic cross-sectional view of the muffler taken along the line A-A of FIG. 4.

As shown in FIG. 3 and FIG. 5, in the present embodiment, a gas outflow pipe 18 is further disposed on the cover 14 in a penetrating manner. The gas outlet 12 is located at an end, away from the housing body 13, of the gas outflow pipe 18.

As shown in FIG. 3 to FIG. 6, in the present embodiment, the partition member 20 includes a first partition plate 21. The first partition plate 21 partitions the cavity into the resonant cavity and the muffling cavity. A gas inflow channel member 15 in communication with the gas inlet 11 and the muffling cavity is disposed in the housing 10. A first through hole 16 in communication with the resonant cavity is defined on the gas inflow channel member 15. The first partition plate 21 is vertically disposed to partition the cavity of the housing 10 into a left portion and a right portion. The portion at the left side of the first partition plate 21 is in communication only with the gas inlet 11 to form the resonant cavity. The portion at the right side of the first partition plate 21 is in communication with both the gas inlet 11 and the gas outlet 12 to form the muffling cavity. The gas inflow channel member 15 extends along a bottom of the housing 10, which is easy to realize the isolation between the resonant cavity and the muffling cavity. In some embodiments, an inner diameter of the gas inflow channel member 15 is in a range from 5 mm to 8 mm, and a diameter of the first through hole 16 is in a range from 1.8 mm to 3 mm.

Gas enters the overall resonant cavity only through the first through hole 16, which reduces low frequency noise in a range from 0 Hz to 1500 Hz. As shown in FIG. 3 to FIG. 6, in the present embodiment, the partition member 20 further includes a second partition plate 22. The second partition plate 22 is disposed on the first partition plate 21 at an angle to partition the resonant cavity into two resonant chambers. The second partition plate 22 defines a second through hole 26 to communicate the two resonant chambers with each other. The second partition plate 22 can be set to control relative sizes of the two resonant chambers, that is, to control a volume ratio between the two resonant chambers. By controlling a value of the ratio, the low frequency noise of compressors with different displacements can be reduced. For example, in the present embodiment, the muffler is particularly adapted to reduce low frequency noise in a range from 680 Hz to 750 Hz. In some embodiments, a thickness of the second partition plate 22 is in a range from 1.8 mm to 2.5 mm, and a diameter of the second through hole 26 is in a range from 1.5 mm to 2.5 mm.

In the present embodiment, the muffling cavity of the muffler includes a plurality of muffling chambers. The gas entering the cavity from the gas inlet 11 sequentially passes through each of the muffling chambers and flowing out from the gas outlet 12. The muffling cavity effectively reduces medium frequency noise in a frequency range from 1500 Hz to 2500 Hz and high frequency noise at a frequency above 2500 Hz. Increasing a quantity of the muffling chambers is beneficial to gradually reduce volumes of medium-high frequency noise in different frequency bands.

Specifically, as shown in FIG. 3 to FIG. 6, in the present embodiment, the partition member 20 includes a third partition plate 23 and a fourth partition plate 24 disposed at an angle with respect to each other, to partition the muffling cavity into a plurality of muffling chambers. The third partition plate 23 is joined to the first partition plate 21. Along a gas flowing direction, the plurality of muffling chambers include a first muffling cavity, a second muffling cavity, a third muffling cavity, and a fourth muffling cavity. The first muffling cavity is in communication with the gas inflow channel member 15. The fourth muffling cavity is in communication with the gas outlet 12.

In some embodiments, a volume of the first muffling cavity is larger than a volume of the second muffling cavity. The volume of the second muffling cavity is larger than a volume of the third muffling cavity. The volume of each of the muffling cavities can be decided according to noise reduction tendency, to save space and improve the noise reduction effect. The positions of the third partition plate 23 and the fourth partition plate 24 can be adjusted according to factors such as a displacement and a power of a compressor, to change a volume relationship between the muffling chambers corresponding to noises at different frequency bands, to further improve the noise reduction effect.

A third through hole 27 is defined on the third partition plate 23 to communicate the second muffling cavity with the third muffling cavity. A fourth through hole 28 is defined on the fourth partition plate 24 to communicate the first muffling cavity with the second muffling cavity. A fifth through hole 29 is defined on the fourth partition plate 24 to communicate the third muffling cavity with the fourth partition plate. In some embodiments, a thickness of the third partition plate 23 is in a range from 1.8 mm to 2.5 mm, a thickness of the fourth partition plate 24 is in a range from 1.2 mm to 2 mm, a diameter of the third through hole 27 is in a range from 3.5 mm to 4.5 mm, and diameters of the fourth through hole 28 and the fifth through hole 29 are both in a range from 3.5 mm to 4.5 mm.

As shown in FIG. 3 to FIG. 6, in the present embodiment, a fifth partition plate 25 is also disposed in the third muffling cavity. The fifth partition plate 25 partitions the third muffling cavity into two portions. Similar to the function of the second partition plate 22, the fifth partition plate 25 adjusts a volume ratio between the two portions of the third muffling cavity, so that the noise reduction effect of the muffling cavity can be further improved by adjusting the volume ratio.

Specifically, as shown in FIG. 3 to FIG. 6, in the present embodiment, a first end of the fifth partition plate 25 is joined to the cover 14. A gap allowing gas to flow therethrough is defined between a second end of the fifth partition plate 25 and the third partition plate 23. In this way, the fifth partition plate 25 and the cover 14 are capable of being manufactured as one piece. This is conducive for the overall production and molding of the muffler. In other embodiments not shown in the accompanying drawings, the fifth partition plate is alternatively disposed on the third partition plate, and a gap allowing gas to flow therethrough is formed between the fifth partition plate and the cover.

In the present embodiment, a refrigerant gas enters the cavity of the muffler from the gas inlet 11. A part of the refrigerant gas enters the two resonant chambers from the first through hole 16 on the gas inflow channel member 15. The other part of the refrigerant gas enters the muffling cavity through the gas inflow channel member 15, sequentially passes through the first muffling cavity, the second muffling cavity, the two portions of the third muffling cavity, and the fourth muffling cavity in the counterclockwise direction in FIG. 3, and is finally discharged out from the muffler through the gas outlet 12.

Figure 6:
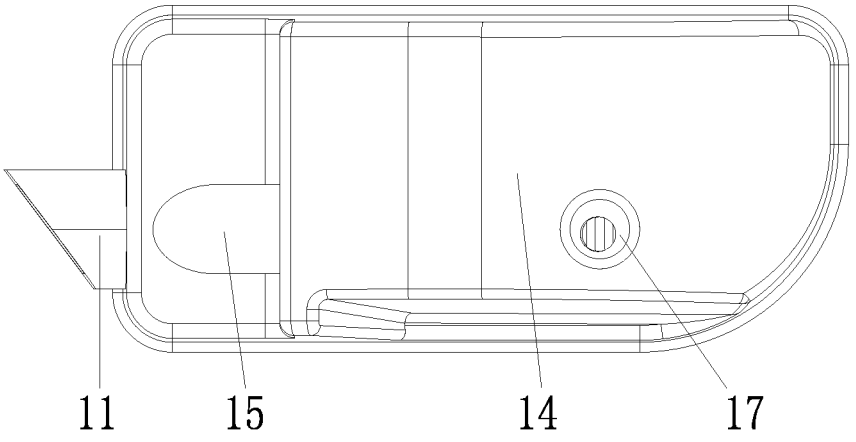
FIG. 6 is a schematic view of the muffler taken from the direction B of FIG. 4.

As shown in FIG. 3 to FIG. 6, in the present embodiment, the bottom of the housing 10 defines an oil leakage hole 17. The oil leakage hole 17 is in communication with each of the muffling chambers. In this way, lubricant oil, refrigeration oil, or another liquid fluid entering the muffler with the compressed gas is discharged out from the muffler through the oil leakage hole 17. As shown in FIG. 6, in the present embodiment, the oil leakage hole 17 is located on a bottom wall of the housing body 13, and a position of the oil leakage hole 17 on the bottom wall corresponds to the fourth partition plate 24. In this way, the oil leakage hole 17 is in communication with both the first muffling cavity and the second muffling cavity. This is conducive for draining oil from the muffling cavity. In some embodiments, an outer surface of a blocking plate of the oil leakage hole is tapered, to prevent mist of refrigeration oil from being sucked into the muffling chambers and discharged together with the refrigerant, in order to prevent a pump body from overheating in suction caused by insufficient cooling-down and to prevent affecting the overall performance of the compressor.

In the present embodiment, as shown in FIG. 3 and FIG. 5, to fix the partition member 20, a plurality of groups of blocking plates are respectively disposed on an inner surface of the housing body 13 and an inner surface of the cover 14, and the blocking plates in each group are opposite to each other. A first slot 91, a second slot 92, a third slot 93, and a fourth slot 94 that fix the partition member are separately formed between the blocking plates. The first partition plate 21 is inserted into the first slot 91 and the third slot 93, and the fourth partition plate 24 is inserted into the second slot 92 and the fourth slot 94, to implement a fixed seal. In some embodiments, a thickness of the blocking plate is in a range from 0.8 mm to 1.2 mm.

The present disclosure further provides a compressor assembly. As shown in FIG. 1, in the present embodiment, the compressor assembly includes a muffler. The muffler includes all or some of the above-described technical structures. In the present embodiment, the compressor assembly has an advantage of reduced noise.

The present disclosure further provides a refrigerator. The refrigerator (not shown in the accompanying drawings) according to the present embodiment includes a compressor and a muffler. The gas outlet of the muffler is in communication with a gas inlet of the compressor. The muffler includes all or some of the above-described technical structures. In the present embodiment, the refrigerator has an advantage of reduced noise.

According to the above-described description, the embodiments of the present disclosure may achieve the following:

The muffling cavity and the resonant cavity are formed in the cavity of the muffler, and the gas entering from the gas inlet passes through the muffling cavity and being discharged from the gas outlet. When the gas passes through the muffling cavity, wave peaks and wave valleys of medium frequency and high frequency noises become gentle, which effectively reduces the volume of this part of noises. The resonant cavity is in communication only with the gas inlet, so that low frequency noise is repeatedly reflected and eliminated in the resonant cavity. The present embodiment can simultaneously eliminate the noises in multiple frequency bands in low frequency and medium-high frequency, which effectively improves the effect of noise reduction.

In the description of the present disclosure, it should be understood that orientation or positional relationships indicated by orientation terms such as "front", "back", "upper", "lower", "left", "right", "horizontal", "vertical", "horizontal", "top", and "bottom" and the like are generally based on orientation or positional relationships shown in the accompanying drawings, and used only for the purpose of facilitating the description of the disclosure and simplifying the description, and that, in the absence of the opposite description, these terms indicating directions do not indicate and imply that the related devices or elements must have a specific direction or be constructed and operated in a specific direction, and are not intended to limit the scope of the disclosure; and the terms "inside" and "outside" refer to the inside and the outside of the outline of each component.

For the convenience of description, terms of spatial relations such as "above", "over", "on a top surface", "upper", etc., may be used herein to describe the spatial position relationships of a device or a feature with other devices or features shown in the drawings. It should be understood that the terms of spatial relations are intended to include other different orientations in use or operation in addition to the orientation of the device described in the drawings. For example, if the device in the drawings is placed upside down, the device described as "above other devices or structures" or "over other devices or structures" will be positioned as "below other devices or structures" or "under other devices or structures". Thus, the exemplary term "above" may include both "above" and "below". The device can also be positioned in other different ways (rotating 90 degrees or at other orientations), and the corresponding explanations for the description of the spatial relations will be provided herein.

In addition, it should be noted that the terms such as "first" and "second" used to define components are merely intended to facilitate the distinction between the corresponding components, if not otherwise stated, the terms have no special meaning, and therefore cannot be understood to limit the protection scope of this disclosure.

What is claimed is:

1. A muffler, comprising:

a housing, the housing defining a cavity, a gas inlet, and a gas outlet, the gas inlet and the gas outlet being respectively in communication with the cavity; and a partition member disposed in the housing, the partition member partitioning the cavity into a resonant cavity and a muffling cavity that are isolated from each other, the resonant cavity being in communication only with the gas inlet, the muffling cavity being in communication with both the gas inlet and the gas outlet, the muffling cavity comprises a plurality of muffling chambers, and gas entering the cavity from the gas inlet is capable of sequentially passing through each of the plurality of muffling chambers and flowing out from the gas outlet; volume of the plurality of muffling chambers gradually decreases from the gas inlet to the gas outlet.

2. The muffler according to claim 1, wherein the partition member comprises a first partition plate, the first partition plate partitions the cavity into the resonant cavity and the muffling cavity, a gas inflow channel member in communication with the gas inlet and the muffling cavity is disposed in the housing, and a first through hole in communication with the resonant cavity is defined on the gas inflow channel member.

3. The muffler according to claim 2, wherein the partition member further comprises a second partition plate, the second partition plate is disposed on the first partition plate at an angle to partition the resonant cavity into two resonant chambers, and the second partition plate defines a second through hole to communicate the two resonant chambers with each other.

4. The muffler according to claim 1, wherein the partition member comprises a third partition plate and a fourth partition plate disposed at an angle with respect to each other, to partition the muffling cavity into a plurality of muffling chambers, the third partition plate is joined to the first partition plate, the plurality of muffling chambers comprise a first muffling cavity, a second muffling cavity, a third muffling cavity, and a fourth muffling cavity along a gas flowing direction, the first muffling cavity is in communication with the gas inflow channel member, and the fourth muffling cavity is in communication with the gas outlet.

5. The muffler according to claim 4, comprising a fifth partition plate disposed in the third muffling cavity, wherein the fifth partition plate partitions the third muffling cavity into two portions.

6. The muffler according to claim 5, wherein the housing comprises a housing body and a cover, the housing body defines an opening, the partition member is disposed in the housing body through the opening, the cover covers the opening of the housing body, the gas inlet is located on the housing body, and the gas outlet is located on the cover.

7. The muffler according to claim 6, comprising a gas outflow pipe disposed on the cover in a penetrating manner, wherein the gas outlet is located at an end, away from the housing body, of the gas outflow pipe.

8. The muffler according to claim 6, wherein an inner surface of the housing body defines a first slot and a second slot, an inner surface of the cover defines a third slot and a fourth slot, the first partition plate engages with the first slot and the third slot in an insertion manner, and the fourth partition plate engages with the second slot and the fourth slot in an insertion manner.

9. The muffler according to claim 6, wherein a first end of the fifth partition plate is joined to the cover, and a gap allowing gas to flow therethrough is defined between a second end of the fifth partition plate and the third partition plate.

10. The muffler according to claim 4, wherein a bottom of the housing defines an oil leakage hole, and the oil leakage hole is in communication with each of the muffling chambers.

11. The muffler according to claim 10, wherein the first muffling cavity and the second muffling cavity are located below the third muffling cavity and the fourth muffling cavity, and the oil leakage hole is correspondingly located below the fourth partition plate and is in communication with both the third muffling cavity and the fourth muffling cavity.

12. A compressor assembly, comprising the muffler according to claim 1.

13. A refrigerator, comprising the compressor assembly according to claim 12.

14. The muffler according to claim 4, wherein a volume of the first muffling cavity is larger than a volume of the second muffling cavity, the volume of the second muffling cavity is larger than a volume of the third muffling cavity.

15. The muffler according to claim 4, wherein a third through hole is defined on the third partition plate to communicate the second muffling cavity with the third muffling cavity; a fourth through hole is defined on the fourth partition plate to communicate the first muffling cavity with the second muffling cavity; and a fifth through hole is defined on the fourth partition plate to communicate the third muffling cavity with the fourth muffling cavity.

16. The muffler according to claim 2, wherein the gas inflow channel member extends along a bottom of the housing.

17. The muffler according to claim 10, wherein an outer surface of a blocking plate of the oil leakage hole is tapered.

18. The muffler according to claim 3, wherein a thickness of the second partition plate is in a range from 1.8 mm to 2.5 mm, and a diameter of the second through hole is in a range from 1.5 mm to 2.5 mm.

19. The compressor assembly according to claim 12, comprising a compressor, wherein the gas outlet of the muffler is in communication with a gas inlet of the compressor.

* * * * *